US005767932A

United States Patent [19]

Gordon

[11] Patent Number: 5,767,932

[45] Date of Patent: Jun. 16, 1998

[54] UNDERWATER DRIVER'S COMBINATION MASK AND LIGHTING ASSEMBLY

[76] Inventor: Michael D. Gordon, 2643 7th St., Apt. A, Santa Monica, Calif. 90405

[21] Appl. No.: 751,710

[22] Filed: Nov. 18, 1996

[51] Int. Cl.[6] ..... G02C 1/00

[52] U.S. Cl. ..... 351/43; 351/158; 362/177

[58] Field of Search ..... 351/43, 158; 362/105, 362/158, 171, 177, 194

[56] References Cited

U.S. PATENT DOCUMENTS 3,010,108 11/1961 Sachs ..... 351/43
4,638,410 1/1987 Barker ..... 362/105
4,734,834 3/1988 Petzl et al. ..... 362/187
4,870,550 9/1989 Uke ..... 362/158

*Primary Examiner*—Huy Mai
*Attorney, Agent, or Firm*—W. Edward Johansen

[57] ABSTRACT

An underwater diver's combination mask and lighting assembly includes a face-plate, a frame, an interface, a lighting assembly and an electrical source. The face-plate is inserted in the frame which has a first side and a second side. The interface is inserted between the frame and the face of the underwater diver. The lighting assembly is mechanically coupled to the frame. The electrical source is electrically coupled to the lighting assembly.

3 Claims, 3 Drawing Sheets

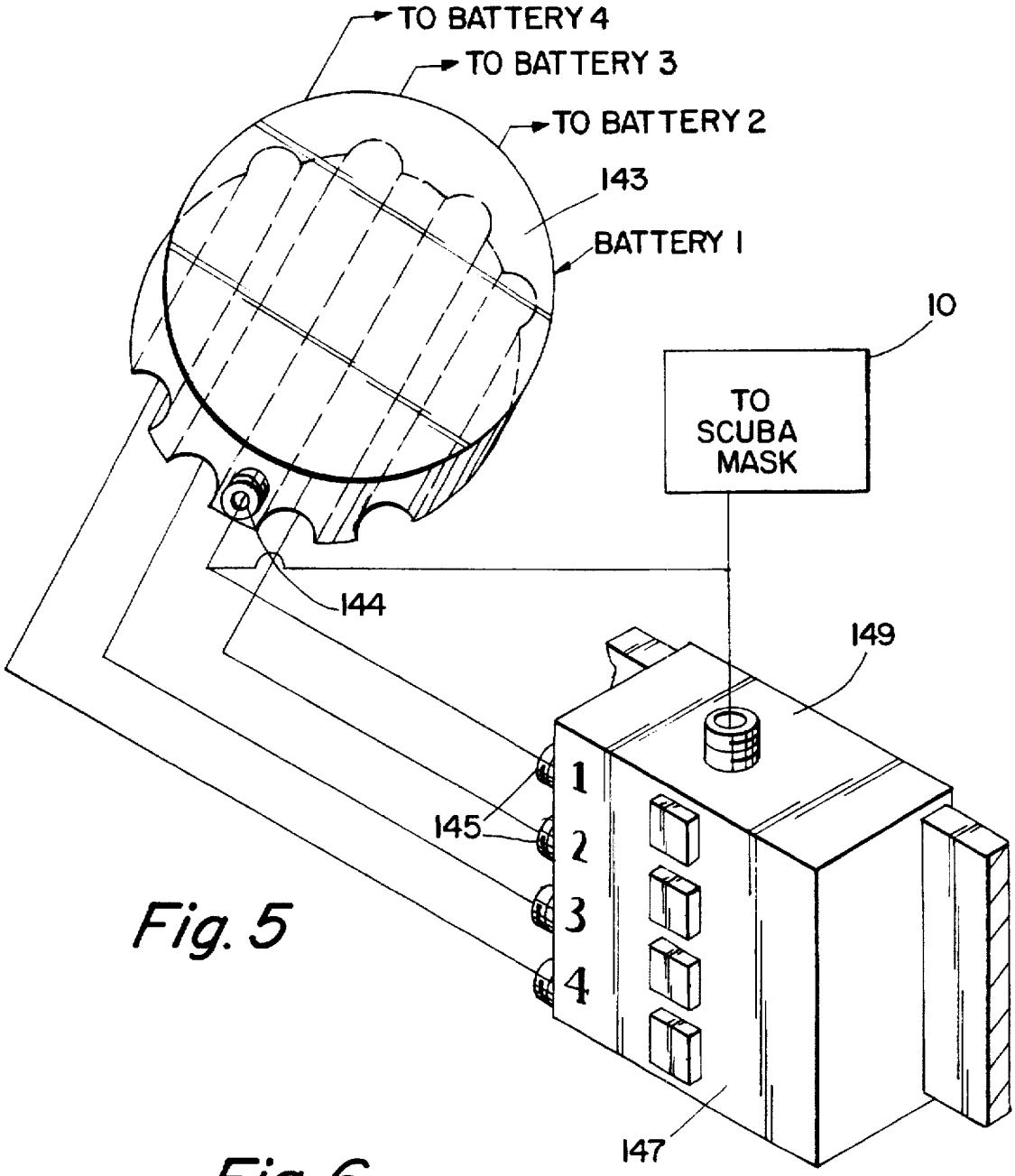
Fig. 5
Fig. 6
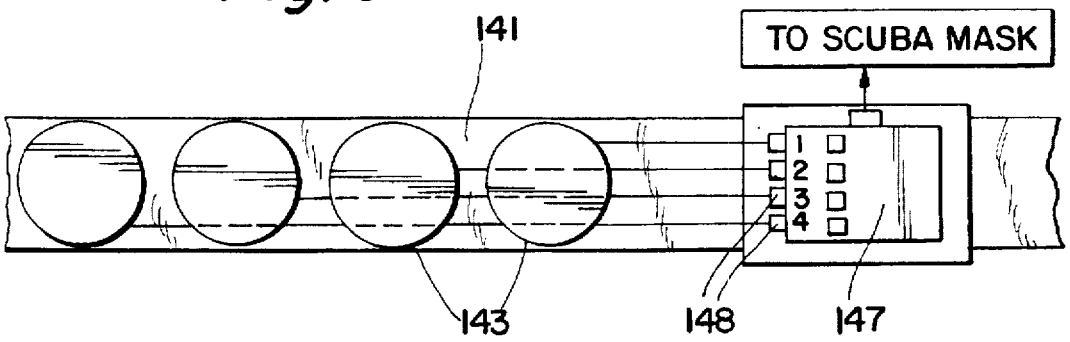

UNDERWATER DRIVER'S COMBINATION MASK AND LIGHTING ASSEMBLY

BACKGROUND OF THE INVENTION

This invention relates to a combination mask and lighting assembly for use by an underwater diver.

U.S. Pat. No. 5,359,371 teaches an underwater diver's mask which includes a face-plate, a frame and an interface. The faceplate is inserted in the frame. The interface is inserted between the frame and the face of the underwater diver.

Heretofore there have been a variety of different illumination devices which provide light for underwater divers and swimmers. U.S. Pat. No. 4,429,350, U.S. Pat. No. 4,638,410, U.S. Pat. No. 4,734,834 and U.S. Pat. No. 4,817,212 teach many of these illumination devices.

Heretofore there have also been a variety of different flashlight headbands and retainers. U.S. Pat. No. 5,053,932, U.S. Pat. No. 5,034,862, U.S. Pat. No. 4,970,631, U.S. Pat. No. 4,887,194, U.S. Pat. No. 4,797,793, U.S. Pat. No. 4,729,499, U.S. Pat. No. 4,718,126, U.S. Pat. No. 4,360,930 and U.S. Pat. No. 3,249,271 teach many of these flashlight headbands and retainers.

U.S. Pat. No. 4,870,550 teaches a waterproof flashlight which receives at least two parallel adjacent rows of batteries, and including a connecting device and a watertight sealing device. The waterproof flashlight is commercially available from Underwater Kinetics of San Marcos, Calif. The waterproof flashlight includes batteries and a bulb and has been found to have a specific gravity of greater than one so as to sink when it is released in water. Straps for connecting the waterproof flashlight to the strap of a dive mask are provided. The light of the underwater flashlight is placed immediately adjacent to the head of the underwater diver. The underwater flashlight includes no support element.

None of the devices which the above mentioned prior art patents teach provides a lightweight, inexpensive, streamlined apparatus for holding a flashlight adjacent to the side of the head of an underwater diver in order to free his the hands for other purposes, while still providing underwater illumination. None of apparati which the above mentioned prior art patents teach provide an apparatus which is designed for releasable connection to head gear worn by underwater divers and which includes an element for providing combined support and orientation to a flashlight and which also includes a combined support and orientation element which has a specific gravity of less than one, thereby providing floatation to the apparatus and to any article which is carried by the apparatus, as well as support and orientation to a flashlight. None of apparati which the above mentioned prior art teaches provides such an apparatus which includes a system for releasably connecting it to the head gear of an underwater diver and to a flashlight and which further includes a structure for orienting the light beam of a lit flashlight inwardly in the direction of the line of sight and close range visual focus of a diver when underwater, yet in which the flashlight is secured to the support at a distance away from the head of a diver in order to keep the beam of the lit flashlight from being deflected by any head gear worn by the diver.

U.S. Pat. No. 5,183,326 teaches an apparatus which holds a flashlight adjacent to the side of the head of an underwater diver in order to free the hands of the underwater diver for other purposes, while still providing underwater lighting. The apparatus is designed for releasable connection to head gear worn by underwater divers and includes an element for providing support to a flashlight. The element for providing support preferably has a specific gravity of less than about one, thereby providing floatation to the apparatus and to any article which is carried by the apparatus, as well as support and orientation to a flashlight. The support is connected to the head gear of a diver and to a flashlight by one or more strap which releasably engages and secures the flashlight to the support, and which strap also releasably engages and secures the support and the flashlight which it carries to the diver. The apparatus also includes a structure for orienting the light beam of a lit flashlight inwardly in the direction of the line of sight and close range visual focus of a diver when underwater. The flashlight is secured to the support at a distance away from the head of an underwater diver in order to keep the beam of a lit flashlight from being deflected by any head gear worn by the underwater diver.

U.S. Pat. No. 4,429,350, U.S. Pat. No. 4,638,410, U.S. Pat. No. 4,734,834, U.S. Pat. No. 4,817,212, U.S. Pat. No. 5,053,932, U.S. Pat. No. 5,034,862, U.S. Pat. No. 4,970,631, U.S. Pat. No. 4,887,194, U.S. Pat. No. 4,797,793, U.S. Pat. No. 4,729,499, U.S. Pat. No. 4,718,126, U.S. Pat. No. 4,360,930, U.S. Pat. No. 3,249,271 and U.S. Pat. No. 4,870,550 teach relevant masks and accessories for underwater divers.

SUMMARY OF INVENTION

The present invention is generally directed to art underwater diver's combination mask and lighting assembly. The underwater diver's combination mask and lighting assembly includes a face-plate, a frame, an interface, a lighting assembly and an electrical source. The faceplate is inserted in the frame. The interface is inserted between the frame and the face of the underwater diver. The lighting assembly is mechanically coupled to the frame. The electrical source is electrically coupled to the lighting assembly.

In a first, separate aspect of the present invention, the light assembly directs the beam of light toward the line of sight of the underwater diver.

In a second, separate aspect of the present invention, the light assembly includes a turret and a light-tube. The turret is rotatably coupled to frame adjacent to the side of the frame. The light-tube is pivotally coupled to the turret at a first end. The light-tube has a cavity. A lamp is disposed in the cavity of the light-tube. The lamp is electrically coupled to the electrical source.

In a third, separate aspect of the present invention, the electrical source includes a plurality of batteries each of which has an output connector and a battery mount and a switching apparatus which has a plurality of input connectors and an output connector. The switching apparatus is selectively switched in order to electrically couple each of the batteries the output connector through one of the input connectors.

Other aspects and many of the attendant advantages will be more readily appreciated as the same becomes better understood by reference to the following detailed description and considered in connection with the accompanying drawing in which like reference symbols designate like parts throughout the figures.

The features of the present invention which are believed to be novel are set forth with particularity in the appended claims.

DESCRIPTION OF THE DRAWINGS

FIG. 5 is a partial perspective drawing of the electrical source of FIG. 4.

FIG. 6 is a schematic drawing of the electrical source of FIG. 4.

DESCRIPTION OF THE PREFERRED EMBODIMENTS

Figure 1:
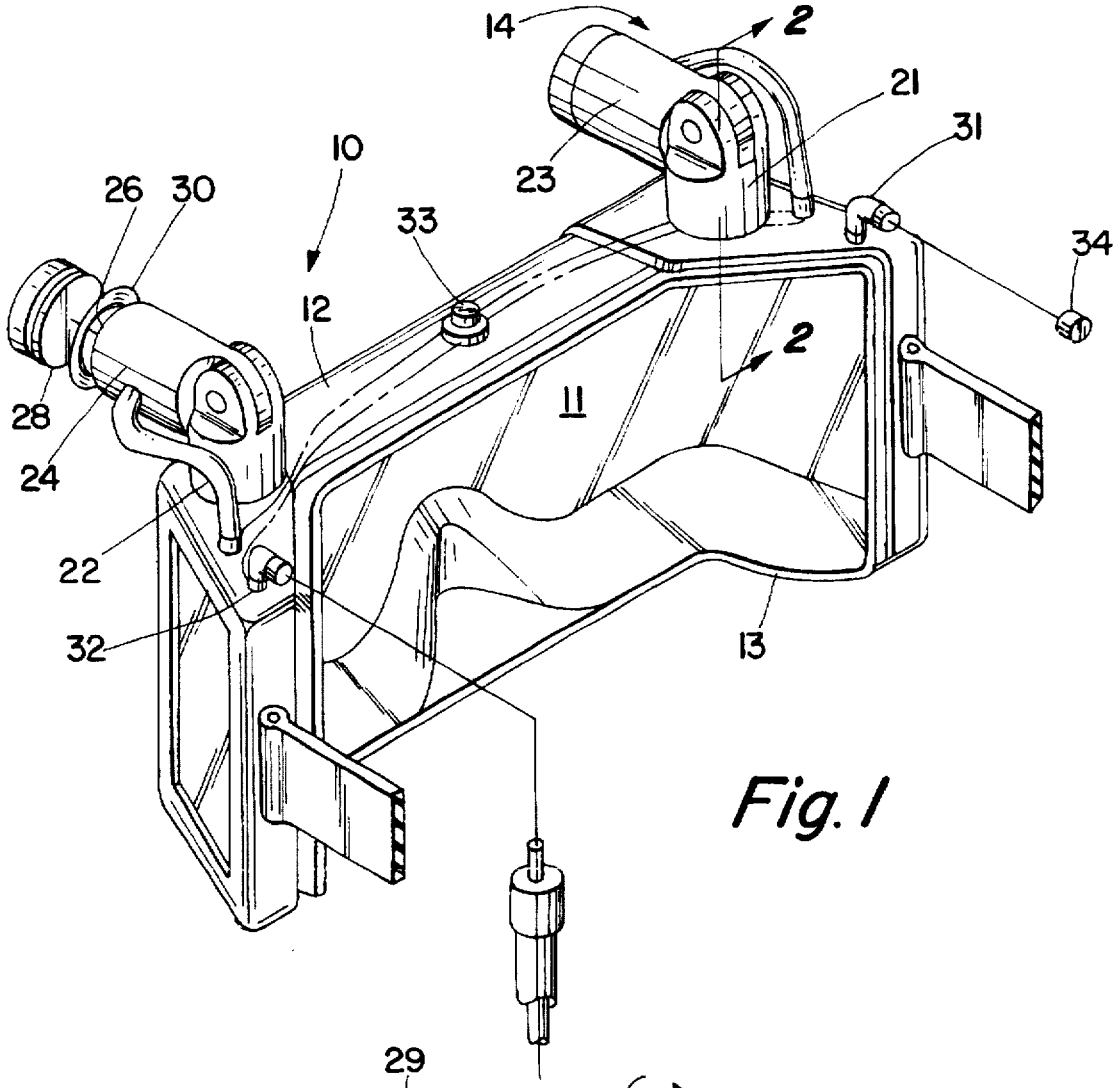
FIG. 1 is a perspective drawing of an underwater diver's combination mask and lighting assembly which includes a face-plate, a frame, an interface and a lighting assembly according to the first embodiment of the present invention.
Figure 2:
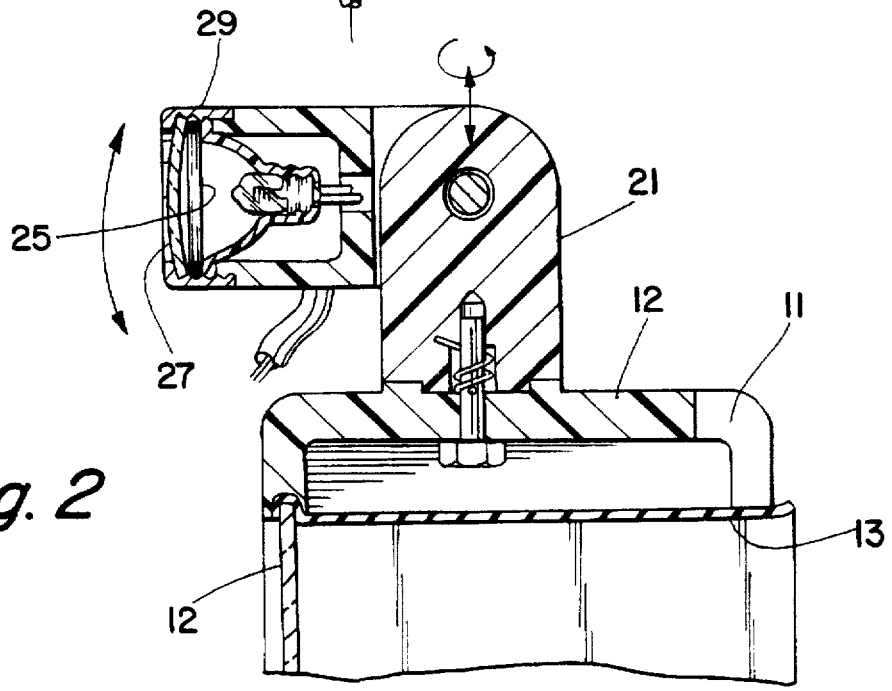
FIG. 2 is a partial side elevational view in cross-section of the underwater diver's combination mask and lighting assembly of FIG. 1.

Referring to FIG. 1 in conjunction with FIG. 2 a combination mask and lighting assembly 10 includes a faceplate 11, a frame 12 which has a first side and a second side, an interface 13 and a lighting assembly 14. The faceplate 11 is inserted in the frame 12. The interface 13 is inserted between the frame 12 and the face of the underwater diver and is generally formed out of a resilient material such as either plastic or rubber. The lighting assembly 14 includes a first turret 21, a second turret 22, a first light-tube 23, a second light-tube 24, a first lamp 25, a second lamp 26, a first lens 27, a second lens 28, a first O-ring 29 and a second O-ring 30. The first and second turrets 21 and 22 are rotatably coupled to the frame 12 adjacent to the first and second sides thereof, respectively. The first and second light-tubes 23 and 24 are pivotally coupled to the first and second turret at their first ends, respectively. The first and second light-tubes 23 and 24 have a cavity and an inner circumferenial groove at their second ends. The first and second lamps are disposed in the cavity of the first and second light-tubes 23 and 24, respectively. The first and second lenses 27 and 28 are disposed in the cavity of the first and second light-tubes 23 and 24 adjacent to the inner circumferenial groove thereof. The first and second O-rings 29 and 30 are disposed in the inner circumferenial groove thereof. The lighting assembly 14 also includes a first input connector 31, a second input connector 32 and a switch 33 which has an off-position, a first on-position and a second on-position. A cap 34 covers either the first input connector 31 or the second input connector 32. The switch 33 electrically couples either the first input connector 31 or the second input connector 32 to the first and second lamps 25 and 26.

Figure 3:
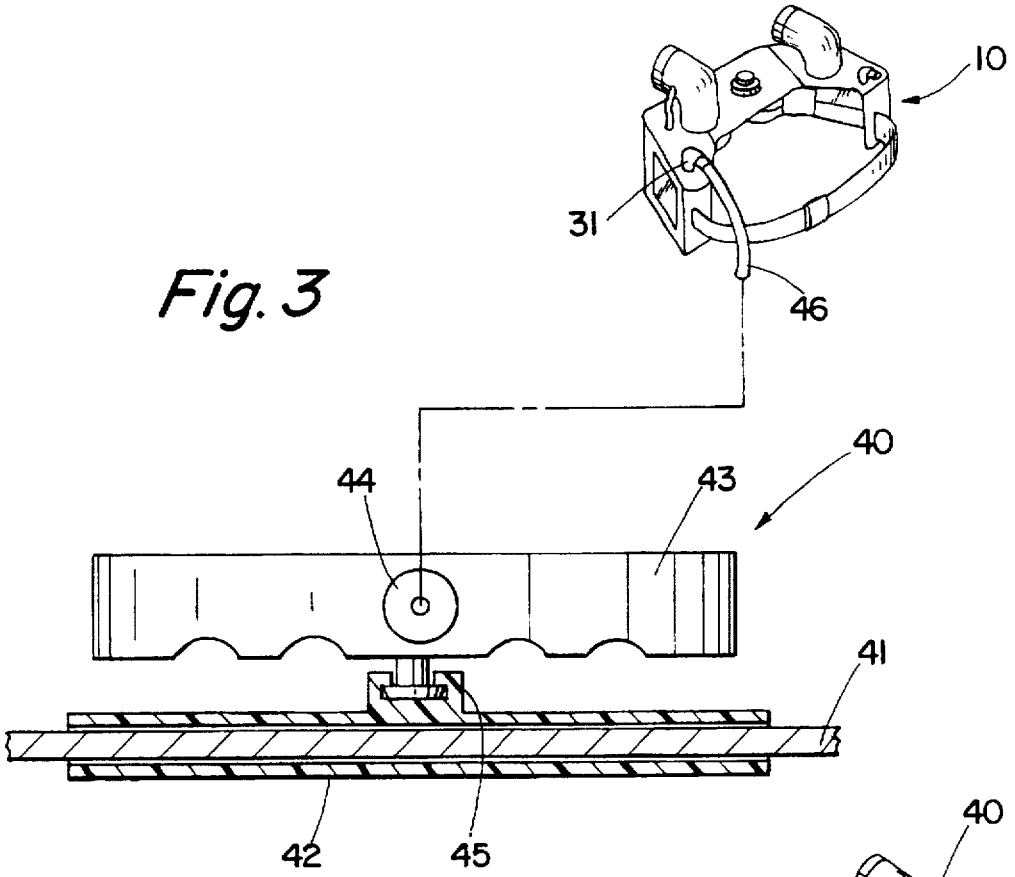
FIG. 3 is a transverse elevational view in cross-section of an electrical source, which includes a belt, a belt loop, a battery, which has an output connector and a battery mount, an output cable, which electrically couples the output connector to the lighting assembly of FIG. 1, according to the second embodiment of the present invention.

Referring to FIG. 3 an electrical source 40 includes a belt 41, a belt loop 42, a battery 43, which has an output connector 44 and a battery mount 45 which mechanically couples the battery 43 to the belt loop 42, and an output cable 46. The output cable 46 electrically couples the output connector 44 of the battery 43 to either the first input connector 31 or the second input connector 32 of the lighting assembly 14.

Figure 4:
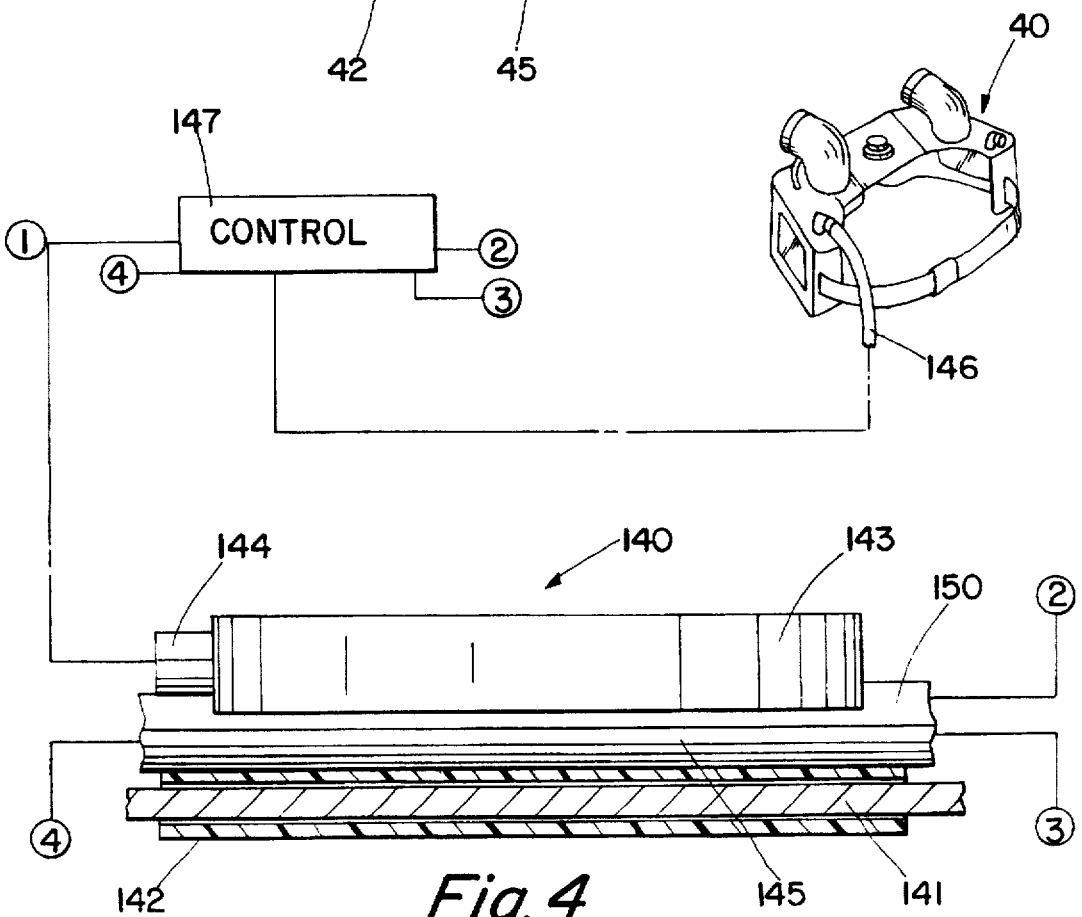
FIG. 4 is a longitudinal elevational view in cross-section of an electrical source, which includes a belt, a belt loop, a plurality of batteries, each of which has an output connector, a switch which has a plurality of input connectors and an output connector, a plurality of input cables, each of which electrically couples one of the output connectors of the batteries to one of the input connectors of the switch, and an output connector, an output cable, which electrically couples the output connector of the switch to the lighting assembly of FIG. 1, according to the third embodiment of the present invention.

Referring to FIG. 4 in conjunction with FIG. 5 and FIG. 6 an electrical source 140 includes a belt 141, a plurality of belt loops 142 and a plurality of batteries 143. Each battery 143 has an output connector 144 and a battery mount 145. Each battery mount 145 mechanically couples one of the batteries 143 to one of the belt loops 142. The electrical source 140 also includes an output cable 146, a switching connector 147 which has a plurality of input connectors 148 and an output connector 149 and a plurality of input cables 150. Each input cable 150 electrically couples the output connector 144 of one of the batteries 143 to one of the input connectors 148 of the switch 147. The output cable 146 electrically couples the output connector 149 of the switching connector 147 to either the first input connector 31 or the second input connector 32 of the lighting assembly 14.

From the foregoing it can be seen that an underwater diver's combination mask and lighting assembly has been described. It should be noted that the sketches are not drawn to scale and that distance of and between the figures are not to be considered significant. Accordingly it is intended that the foregoing disclosure and showing made in the drawing shall be considered only as an illustration of the principle of the present invention.

What is claimed is:

1. An underwater diver's combination mask and lighting assembly comprising:

a. a face-plate;

b. a frame in which said face-plate is inserted, said frame having a first side and a second side;

c. an interface inserted between said frame and the face of the underwater diver;

d. a lighting assembly mechanically coupled to said frame; and e. an electrical source electrically coupled to said lighting assembly, said lighting assembly including:

i. a first turret rotatably coupled to said frame adjacent to said first side of said frame;

ii. a first light-tube pivotally coupled to said first turret at a first end, said first light-tube having a cavity and an inner circumferenial groove at a second end;

iii. a first lamp disposed in said cavity of said first light-tube, said first lamp being electrically coupled to said electrical source;

iv. a first lens disposed in said cavity of said first light-tube adjacent to said inner circumferenial groove; and v. a first O-ring disposed in said inner circumferenial groove.

2. An underwater diver's combination mask and lighting assembly according to claim 1 wherein said lighting assembly further includes:

a. a second turret rotatably coupled to said frame adjacent to said second side of said frame;

b. a second light-tube pivotally coupled to said first turret at a first end, said second light-tube having a cavity and a inner circumferenial groove at a second end;

c. a second lamp disposed in said cavity of said second light-tube, said second lamp being electrically coupled to said electrical source;

d. a second lens disposed in said cavity of said second light-tube adjacent to said inner circumferenial groove; and e. a second O-ring disposed in said inner circumferenial groove.

3. An underwater diver's combination mask and lighting assembly according to claim 1 wherein said electrical source includes:

a. a plurality of batteries each having an output connector and a battery mount; and b. a switching apparatus having a plurality of input connectors for coupling the respective output connector of said batteries and an output connector, said switching apparatus being selectively switched in order to electrically couple each of said batteries to said light assembly.

* * * * *